United States Patent [19]

Bolz

[11] Patent Number: 4,588,301

[45] Date of Patent: May 13, 1986

[54] CONICAL SCREW MIXER

[76] Inventor: Alfred Bolz, Isnyer Strasse 76, D-7988 Wangen/Allg., Fed. Rep. of Germany

[21] Appl. No.: 537,866

[22] Filed: Sep. 30, 1983

[30] Foreign Application Priority Data

Dec. 11, 1982 [DE] Fed. Rep. of Germany ..... 32245935

[51] Int. Cl.[4] ..... B01F 7/14; B01F 7/08

[52] U.S. Cl. ..... 366/287; 277/3; 277/30; 277/71; 366/314

[58] Field of Search ..... 277/30, 106, 3, 70, 277/71, 72 R, 72 FM, 75, 76; 366/244, 279, 287, 314, 318, 331; 464/132, 133, 173, 175, 905, 7, 11

[56] References Cited

U.S. PATENT DOCUMENTS

| | | | |
|---|---|---|---|
| 1,843,404 | 2/1932 | Rasmussen . | |
| 2,008,830 | 7/1935 | Johnson . | |
| 2,247,439 | 7/1941 | Hawes . | |
| 2,295,098 | 9/1942 | Cornell . | |
| 2,539,436 | 1/1951 | Kost . | |
| 2,573,709 | 11/1951 | Hill . | |
| 2,767,963 | 10/1956 | Ringen . | |
| 2,867,997 | 1/1959 | Lake . | |
| 2,893,709 | 7/1959 | Nauta . | |
| 3,118,655 | 1/1964 | Nauta . | |
| 3,222,887 | 12/1965 | Barletta . | |
| 3,315,947 | 4/1967 | Nauta . | |
| 3,338,562 | 8/1967 | Fox | 366/287 |
| 3,556,487 | 1/1971 | Nauta . | |
| 3,602,486 | 8/1971 | Nauta . | |
| 3,659,862 | 5/1972 | Sebestian | 277/106 |
| 3,775,863 | 12/1973 | Updegrove . | |
| 3,895,810 | 7/1975 | Swearingen | 277/71 |
| 3,899,159 | 8/1975 | Nauta . | |
| 3,933,052 | 1/1976 | Coles . | |
| 3,937,444 | 2/1976 | Kapp . | |
| 4,072,297 | 2/1978 | de Vries | 366/287 |
| 4,123,174 | 10/1973 | Titus . | |
| 4,171,819 | 10/1979 | Martineau . | |

FOREIGN PATENT DOCUMENTS

| | | |
|---|---|---|
| 533396 | 9/1931 | Fed. Rep. of Germany . |
| 1956007 | 3/1971 | Fed. Rep. of Germany . |
| 2452005 | 5/1976 | Fed. Rep. of Germany . |
| 2701799 | 7/1977 | Fed. Rep. of Germany . |
| 7902925 | 1/1979 | France . |

OTHER PUBLICATIONS

Copy of Feb. 2, 1984 Communication from German Patent Office and Copy of Applicant's Response Dated Jun. 13, 1984 with Regard to W. German App. Ser. No. P 32 45 935.1.

Copies of May 7, 1984 Communication from the European Patent Office and Applicant's Response Dated Jul. 20, 1984 in Connection with a European Patent Application.

*Primary Examiner*—Robert W. Jenkins

*Attorney, Agent, or Firm*—Lilling & Greenspan

[57] ABSTRACT

The conical screw mixer has a mixing vessel tapering toward the bottom region; in it, parallel to the inner wall, a rotationally driven mixing screw runs in the product chamber. At the bottom area a non-rotational compensating coupling is arranged, which is provided outside the product chamber and below the mixing vessel.

The seal between the rotating part of the angularly movable coupling and the product chamber is below the mixing vessel.

The seal between the rotating part of the angularly movable coupling and the product chamber is effected by the rotating part being sealingly connected with a sealing bell, and external sealing surfaces of the sealing bell, and external sealing surfaces of the sealing bell roll off on a fixed gasket flange.

12 Claims, 7 Drawing Figures

CONICAL SCREW MIXER

BACKGROUND OF THE INVENTION

The invention relates to conical screw mixers having a mixing screw which runs parallel to and along the inner wall of the product chamber conical screw mixer as initially mentioned serves to mix and process powdery, liquid, or pasty fluids in chemical process technology, in the food industry and in related branches of industry.

The mixing screw, disposed in the interior, rotates about the longitudinal axis and is moved parallel to and along the inner wall in the product chamber. This requires a non-rotational, angularly movable coupling in the bottom area which transmits both the rotation of the mixing screw and the pivotal movement of the mixing screw along the inner wall in the product chamber to a fixed bearing. To this end the use of a universal joint a non-rotational compensating coupling is known, the known conical screw mixers having the universal joint arranged directly in the product chamber. The universal joint was protected against access of products by an accordion.

The suspension of a non-rotational compensating coupling (in particular a universal joint) directly in the product chamber is disadvantageous, because the compensating coupling is difficult to get at for maintenance. If the accordion was damaged, there was danger that the vessel content would get in contact with the then exposed universal joint, and the contents would thereby become contaminated. Moreover, operational supervision of such a known universal joint was not possible. Disposition of a universal joint inside the product chamber has the further disadvantage that dirt and bacteria corners form, causing an adverse effect on the product being processed in the vessel. Moreover, it was necessary to make the mixing vessel with a universal joint arranged therein relatively large in order to accommodate the entire lower bearing.

SUMMARY OF THE INVENTION

The invention has set itself the task of developing a conical screw mixer of the initially mentioned kind in such a way that its non-rotational, angularly movable coupling disposed on the bottom no longer presents any danger of contact with the product content, and that the entire arrangement is much simpler and operationally safer.

For the solution of the problem posed, the invention is characterized in that the angularly movable coupling is arranged outside the product chamber of the mixing vessel and the mixing vessel.

In the present invention, protection is claimed generally for arranging an angularly movable coupling outside and below the mixing vessel. Merely in a preferred embodiment is this angularly movable coupling claimed as a universal joint, other realizations of angularly movable couplings being possible and being included in the scope of protection of the present invention (for example homokinetic couplings and the like).

The design of the angularly movable coupling as a universal joint is preferred. The rotatable and pivotable part of the universal joint protrudes into the product chamber and is sealingly spanned by a sealing bell, against the outer circumference of which a fixed gasket flange applies sealingly.

Hence, solid sealing surfaces are proposed, which are no longer exposed to such danger of damage as the previously mentioned accordion. By the arrangement of a hemispherical sealing bell in conjunction with a gasket flange sealingly applying thereon, the essential advantage is achieved that the rotating as well as the pivoting movement of the movable part of the universal joint is absorbed without any special problems.

A special advantage results when the bottom region of the mixing vessel is formed by a vessel flange welded to the side walls, on the inner side of which the gasket flange is secured, the gasket flange having a central cutout in which the sealing bell is supported.

This results in a particularly simple construction, allowing the fixed gasket flange to be unscrewed and removed from the vessel flange, so that the entire bottom suspension together with the mixing screw attached thereto can be extracted from the mixing vessel downwardly. This saves much labor and installation time.

To increase the life of the proposed sealing system and to adapt this sealing system to various sealing tasks, it is provided that an automatic readjustment of the seal between the sealing bell and gasket flange is provided by the outer circumference of the gasket flange being disposed on the inner circumference of a setting flange, the setting flange pressing the gasket flange against the sealing surfaces of the sealing bell by means of spring-loaded set screws.

Thereby a force-locking application of the gasket flange against the sealing bell is provided, which automatically readjusts itself. As a result, in accordance with the wear of the sealing bell and gasket flange, a uniform contact pressure of the two named parts on each other always occurs.

Thereby sealing problems due to thermal expansion are also avoided, because the spring-loaded initial tension of the fixed gasket flange yields and thus equalizes thermal expansions.

A special design of the gasket flange has the advantage that any product medium getting from the product chamber between the sealing bell and the gasket flange is scraped off again at the seal points and thus a kind of labyrinth is created.

The design of the sealing surface with flushing rings has the advantage that the sealing bell or the fixed gasket flange can be cleaned without disassembly of the suspension. Furthermore these flushing rings can be used as a cooling system for the sealing bell. If optimum sealing should be necessary, it is possible to fill the flushing ring with pressurized sealing fluid.

As the shaft or respectively the mixing screw suspension is outside the vessel, the bearing proposed according to the invention can be employed universally and also permits use at higher temperatures. The air space between the fixed gasket flange and the sealing bell and the bearing housing acts at the same time as an insulating layer. Besides, the universal joint and the sealing bell can be flushed from within with sealing fluid or cooling fluid or a gas. For this purpose connections for inflow and outflow of the cooling fluid are made in the bearing cover.

Thus functionality is ensured even at very high vessel temperatures, since by means of the sealing fluid or cooling fluid the bearing points can be maintained at constant temperature,.

As the shaft or mixing screw is connected with the screw-bolt or respectively the entire suspension through a female thread by way of a coupling piece, the product chamber does not contain any screws or other connecting elements. This makes possible a design without dirt and bacteria corners as required for the drug and food industry. If a mixing screw is to be inserted, it can be brought down to the vessel bottom (vessel flange) and ensures a mixer design without lower dead spaces for the product being mixed.

The pivot point of the shaft or mixing screw is disposed outside the mixing vessel. The fixed gasket flange with the setting flange can be made so large that the mixing screw can be introduced into the mixing vessel through the vessel-side flange from below. For large conical mixing vessels a one-part construction of the mixing vessel without intermediate flange is thus made possible. This has considerable advantages in the vessel layout and also makes possible a low-cost design of the mixing vessel.

In the product chamber and in the bearing space different pressures may prevail. To relieve the seals of the sealing bell at the contiguous part of the universal joint and also the gasket flange from these additional pressure loads, a pressure equalization between the product chamber and the bearing space may be carried out. For this there are various possibilities.

Firstly, pressure relief of the seal ring can be achieved by connecting the product chamber with the flushing ring by a first pressure relief line. If only the bearing space is to be pressure-relieved, and thereby also the seal rings between the sealing bell and the movable part of the universal joint, pressure relief must be carried out with a second pressure relief line. Optimum pressure relief is achieved by a combination of these two pressure relief lines. The result is that the seal rings in contact with product have much longer useful lives. If such a pressure relief is to be effected at higher operating temperatures, the lower bearing block may be cooled additionally with a double jacket.

Through the fact that the universal joint is arranged outside and below the mixing vessel, the further essential advantage results that the rotary drive of the mixing screw can be effected by a gear motor flanged to the universal joint. Due to the drive of the mixing screw from below, especially in the case of conical screw mixers, expensive and complicated bevel gear drives can be dispensed with. Merely a rigid guide arm is required which guides the mixing screw.

Drive of the mixing screw from below also has advantages with respect to the vessel size. At equal useful volume the mixing vessel space can be made much smaller in overall dimensions, because the use of space-taking bevel/miter gear drives is obviated. Hence a more compact construction of the mixing vessel at equal useful volume-as compared with known mixing vessels-becomes possible.

All data and features disclosed in the documents, in particular the physical realization illustrated in the drawings, are claimed as essential to the invention insofar as they singly or in combination are novel relative to the prior art.

BRIEF DESCRIPTION OF THE DRAWINGS

In the following, the invention will be explained more specifically with reference to drawings which represent merely one form of realization. From the drawings and their description further essential advantages and features of the invention will become evident.

DETAILED DESCRIPTION OF THE INVENTION

Figure 6:
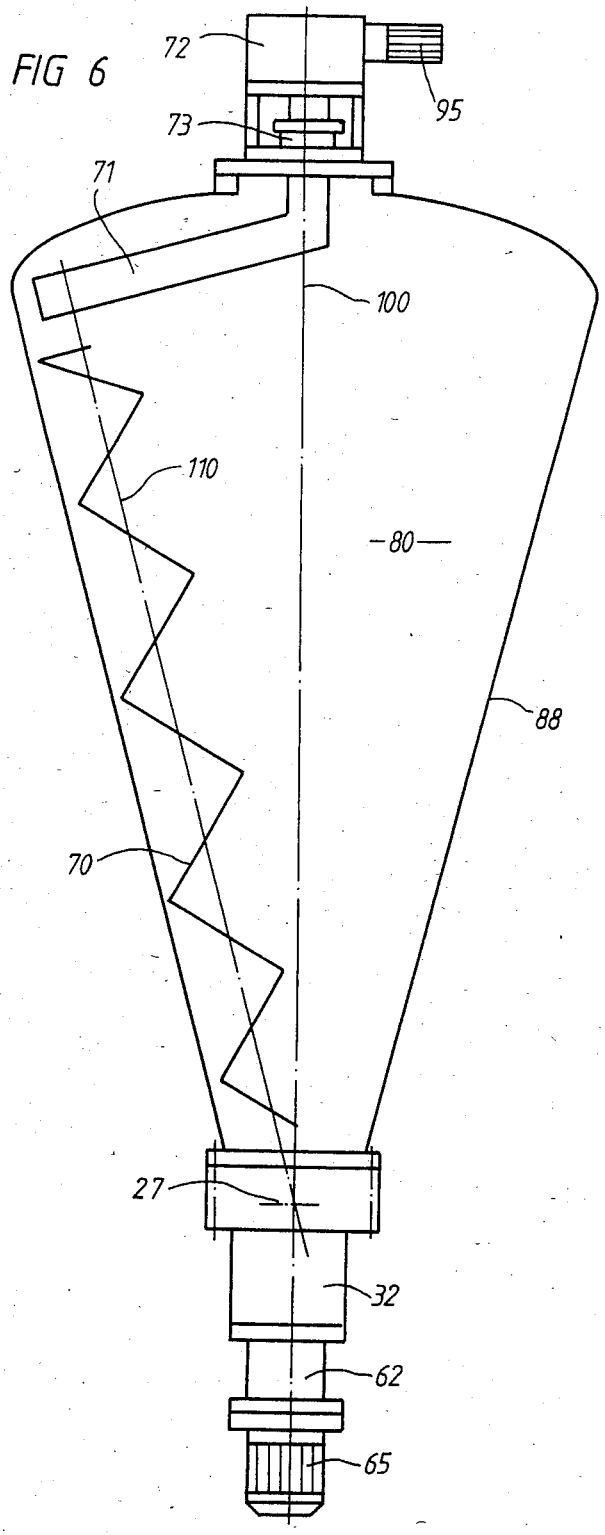
FIG. 6 is a schematically drawn side view of a conical screw mixer according to the invention.

According to FIG. 6, in a mixing vessel 88 tapering toward the bottom region a mixing screw 70 is arranged, which revolves at a speed $n_1$ about its axis 110 and which pivots at a speed $n_2$ about the vessel axis 100. For this purpose the mixing screw 70 is arranged in its upper region at the free end of a guide arm 71, which is driven at a speed $n_2$ by a motor 95 and a transmission 72. At the vessel cover appropriate seals 73 are provided to prevent issuance of the product medium from the product chamber 80.

The bottom-side suspension of the mixing screw 70 is effected in the manner proposed in FIGS. 1 to 5 by means of a universal joint 27, the mixing screw receiving its rotary drive (drive about axis 110) via a cardan shaft 34 which is mounted in the hollow shaft 32, at the end of which a lantern 62 is flanged on, at the lower end of which the gear motor 65 is attached.

Figure 1:
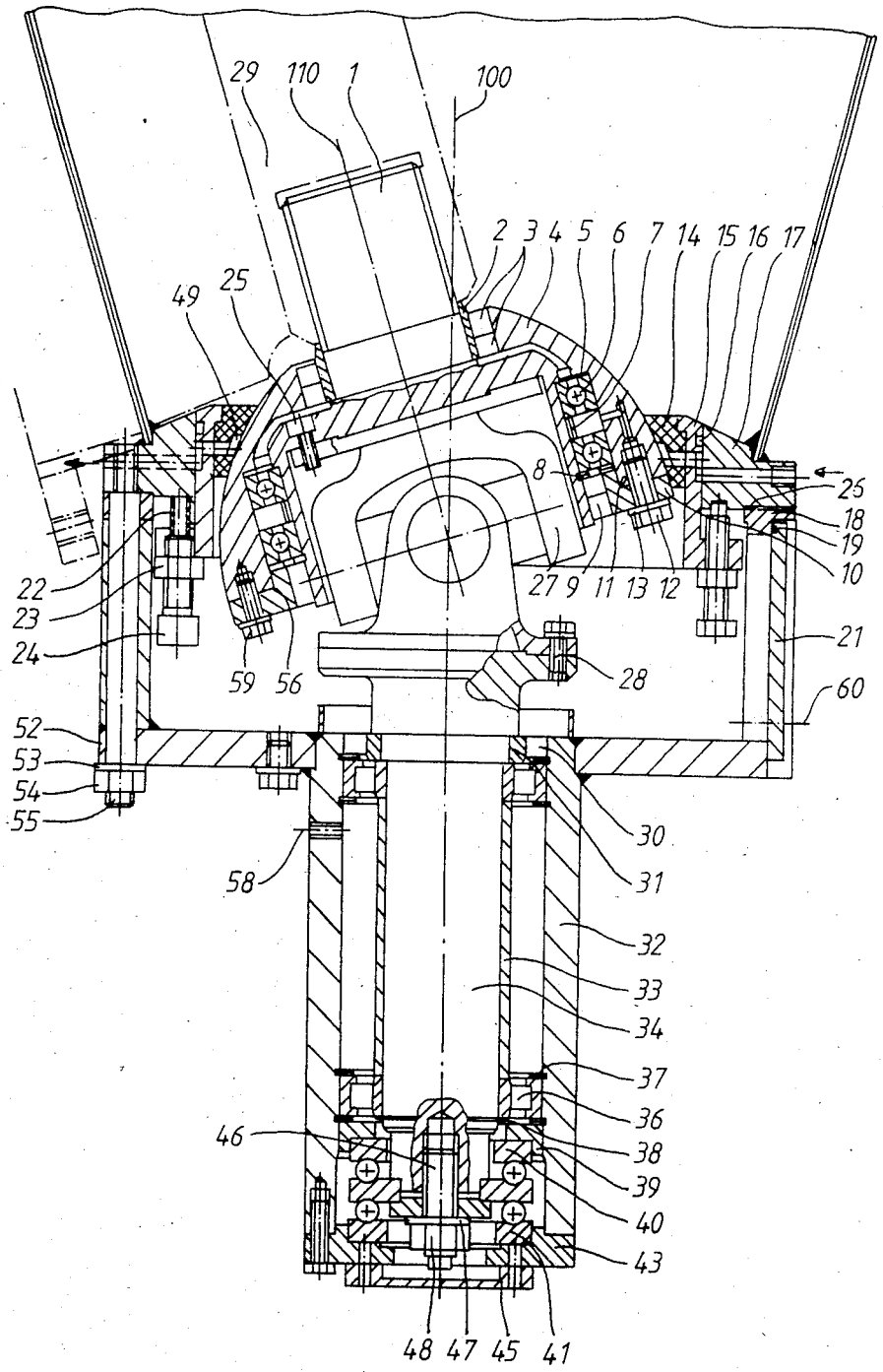
FIG. 1 is a vertical section through the bottom-side suspension of the mixing screw in a conical screw mixer.

According to FIG. 1, the mixing screw 70 is welded fast to a coupling piece 29 with internal thread. Into this coupling piece 29 a screw-in belt 1 is screwed in such a way that during operation the thread tightens by itself, which means that depending on the direction of rotation of the mixing screw 70 a right-hand or left-hand thread is used.

Instead of the coupling piece 29 with internal thread, a non-rotational union of the coupling piece 29 and screw-in bolt 1 may be ralized with a fitting key or a shear pin.

On the screw-in bolt 1 a bushing 2 is fitted. The rolling bearing 6 as well as the bushing 7 are applied without play on the screw-in bolt 1 by means of the lock ring 8. Belt 1 is connected non-rotationally with the top part of the universal joint 27 by screws 25. The bottom part of the universal joint is screwed to cardan shaft 34 non-rotationally with screws 28.

Over the screw-in bolt 1 with busing 2, over the rolling bearing 6, bushing 7 and lock ring 8, as well as over the universal joint 27 is slipped a sealing bell 4 with inset seals 3 and it is axially and radially secured by means of a flange 10 with seal 9 and shim rings 5. Sealing is effected through the O-ring 56. The screw connection occurs through the screws 59. Relubrication of the bearings is effected through the blind screw 12 of the seal plate 13. An additional seal is ensured through the O-ring 11. The construction and assembly must ensure that the center of the universal joint 27 and the center of the sealing bell 4 are one and the same point. The mixing screw shaft may be inclined as much as 25° to the vertical axis.

On cardan shaft 34 a bushing 31 (shaft protection sleeve) is applied non-rotationally. In addition the inner races of the bearings 36 as well as the tube 33 are applied on the cardan shaft 34 and secured with the lock ring 38. The cardan shaft 34 is provided with several centerings for the bearings as well as with a threaded pin 46 with square head.

The bearing box consists of a tubular housing 18, a counter-flange 52, and a hollow shaft 32, which are welded together. In the tubular housing 18 several mouting and inspection openings are disposed, which are closed with several covers 21 arranged on the circumference of the bearing box, with the screws 60 and seal rings 19.

In the hollow shaft 32 the outer races of bearing 36 are inserted and are secured against axial shifting by the lock rings 37. The bearing flange 43 as well as the double-action thrust bearing 40 are inserted into the hollow shaft 32. The bearing flange 43 with the O-ring 42 is now slipped into the bore of the hollow shaft 32 or respectively over the outer race of bearing 40 and firmly joined with the hollow shaft 32 by the screws 60. The bearing flange 39 must apply firmly against the lock ring 37, and the thrust bearing 40 must be axially adjusted almost without play. In addition, the shaft seal ring 30 and the lubrication nipple 58 are pressed into the hollow shaft 32.

Thereafter the cardan shaft 34 is inserted. With the clamping disk 41, spring ring 47 and nut 48 the cardan shaft 34 is firmly connected with the thrust bearing 40.

The connection of the mixing screw 70 with the screw-in bolt 1 is effected by turning the square head of cardan shaft 34, the coupling piece 29 screwing itself onto the thread of bolt 1. This can be done without disassembly of the bearing arrangement. After completion of these operations, the bearing flange 43 is closed with the cover 45, the O-ring 44 and the screws 61.

The bearing box is screwed to the vessel flange 17 non-rotationally by means of threaded bolts 55, nuts 54 and spring rings 53 and is sealed with an O-ring.

The seal between bell 4 and vessel flange 17 is effected with a gasket flange 14 and a setting flange 15 with O-ring 16.

The material of the gasket flange 14 may be Teflon (registered trademark of Du Pont) or other sliding bearing material. The material of the sealing bell 4 must be a hardened, plated, or special steel material or another material compatible with the gasket flange 14.

Figure 3:
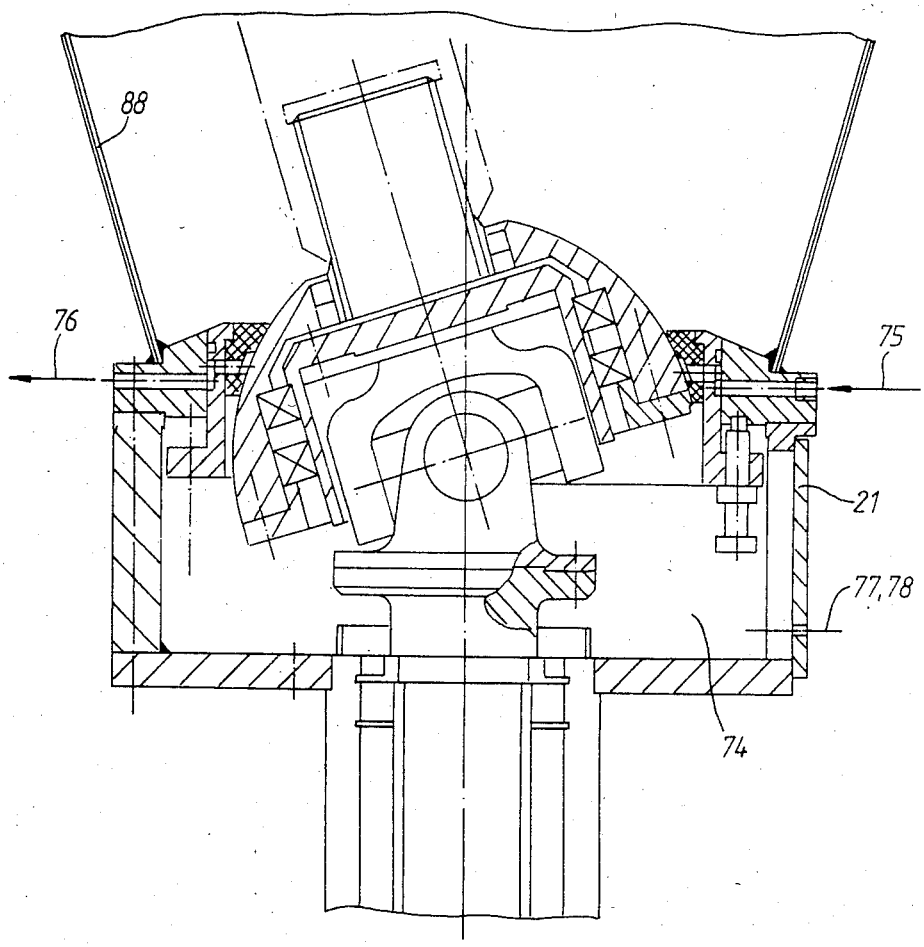
FIG. 3 is a vertical section showing the introduction of flushing and cooling fluid.

The gasket flange 14 has an inner flushing ring 49, which is provided with an inlet/outlet bore drilled through the setting ring 15. FIG. 3 shows that the inlet/outlet 75, 76 starts at the bearing box above the covers 21.

The inlet and outlet bore of the setting and gasket flange 14, 15 is at the same place as the inlet/outlet bore in the vessel flange 17.

The setting flange 15 is secured against rotation by a screw bolt 20 with lock nut. In the setting flange 15 are provided several spring-loaded tensioning screws 24 with lock nut 23 and the springs 22. These tensioning screws 24 press the setting flange 15, with the gasket flange 14 down, against the sealing surface of the sealing bell 4. The friction forces between bell 4 and gasket flange 14 must be greater than the friction forces caused by the rolling bearings 6 and by the seals 3 and 9. It is thereby ensured that the mixing screw 70 revolves in bell 4 and hence the sealing bell 4 executes only a tilting movement corresponding to the rotational speed $n_2$.

Figure 5:
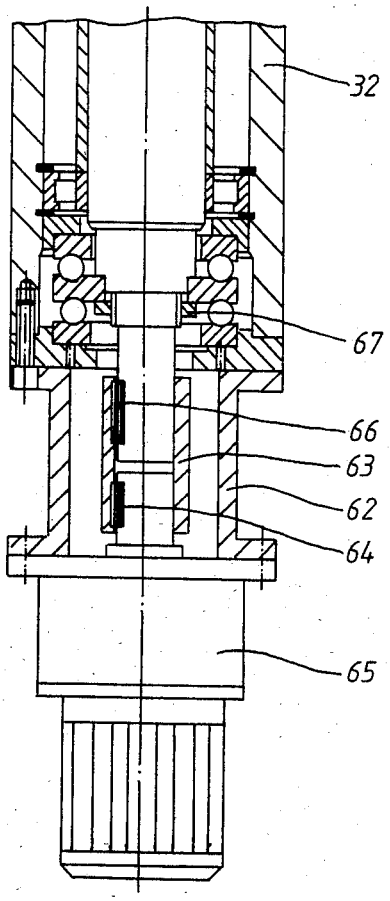
FIG. 5 is a view of the rotary drive of the cardan joint by gear motor.

FIG. 5 shows a special design of the suspension according to the invention. Here the cardan shaft 34 is provided with a longer shaft butt, into which the fitting key 66 is inserted. The axial fixation of the cardan shaft 34 with the bearing 40 is effected by a threaded nut 67. At the connecting flange 43 a lantern 62 is screwed on at one side, while a gear motor 65 is mounted on the other side. The torque entrainment from the gear motor 65 to the cardan shaft 34 is effected through the fitting key 64 and coupling 63. Thus the mixing screw 70 can be driven from below by way of the cardan shaft 34, the universal joint 27 and the screw-in bolt 1.

Figure 7:
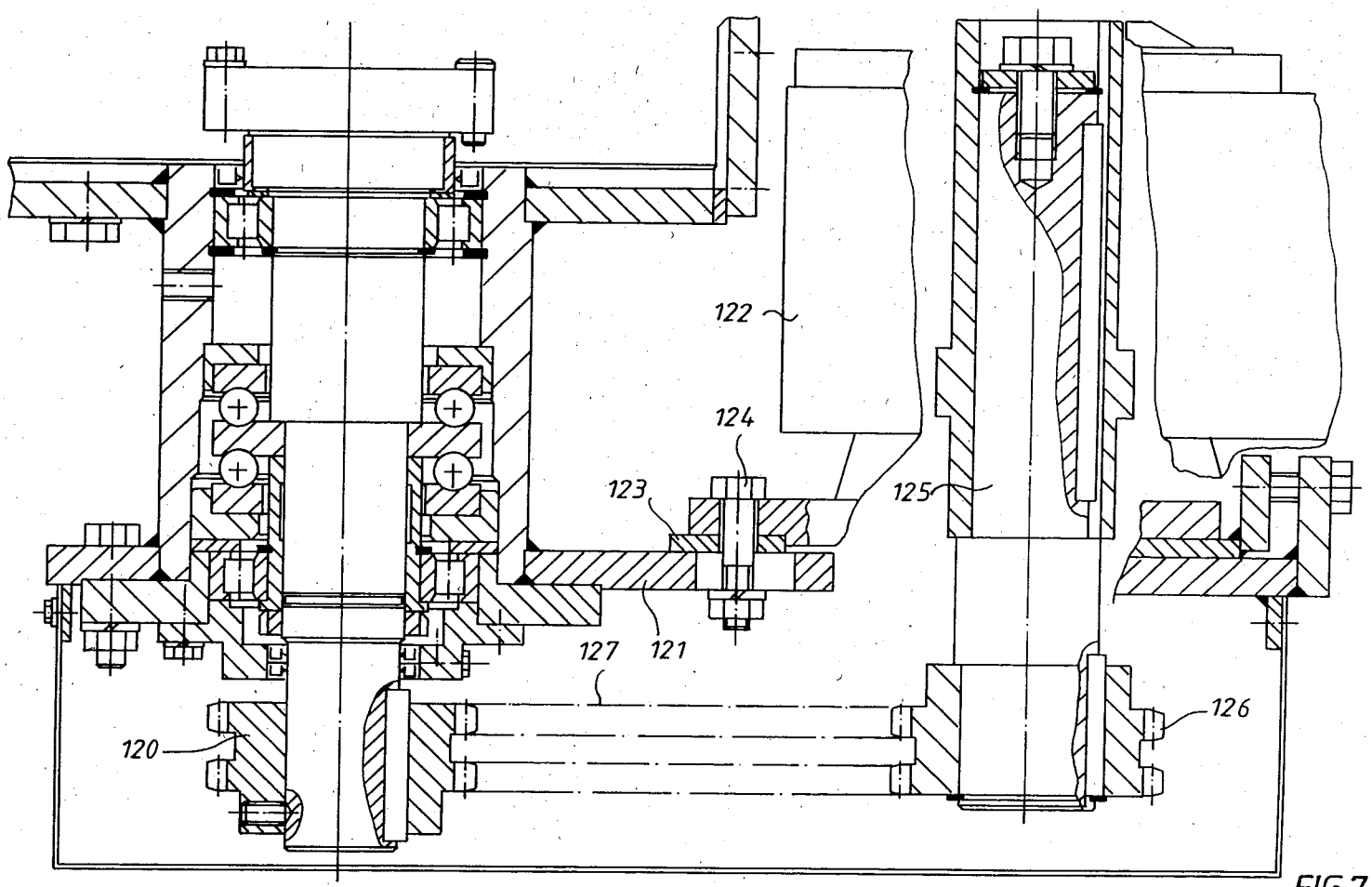

FIG. 7 shows a special design of the mixing screw drive from below, a sprocket wheel 120 being non-rotationally mounted on the cardan shaft 34. At the hollow shaft 32 a motor seating flange 121 is provided. The hollow shaft gear motor 122 is connected with the motor seating flange 121 by an intermediate flange 121 with screws 124. In the hollow-shaft gear motor 122 a drive shaft 125 with mounted sprocket wheel is applied non-rotationally. The transmission of force from the sprocket wheel 126 to the cardan shaft 34 is effected by a chain 127.

The condition for the drive from below is explained schematically once more in FIG. 6. What is essential is that the mixing screw 70 is driven from below and guided in the guide arm 71 at the top. This guide arm 71 is connected non-rotationally with a gear motor 72. The seal 73 can be effected by a stuffing box, a slide ring seal, or another sealing element. Thus the rotary movement of the mixing screw 70 is brought about by the lower gear motor 65, the pivoting movement of the mixing screw by the upper gear motor 95 and transmission 72.

Figure 2:
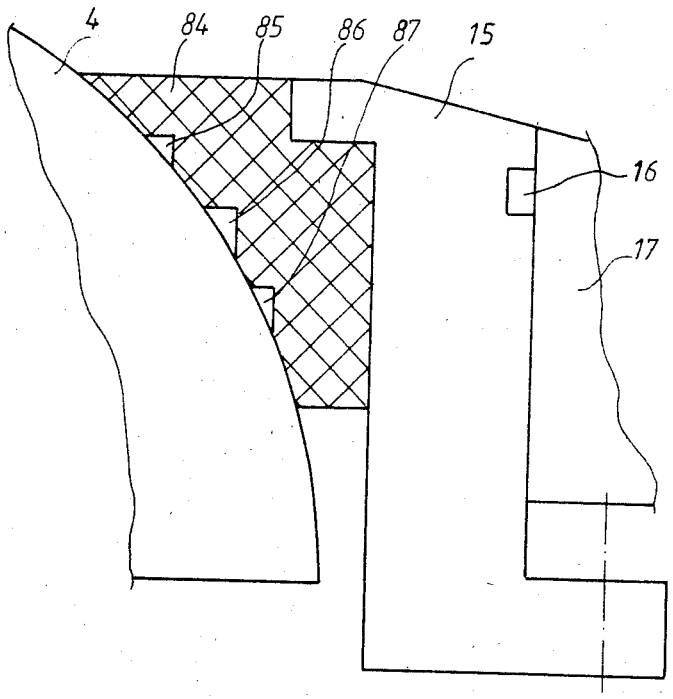
FIG. 2 is an enlarged partial view of the seal between the sealing bell and the fixed gasket flange in an embodiment modified in relation to FIG. 1.

Essential in FIG. 2 is that a special design of the gasket flange 84 is created by the fact that several grooves 85, 86, 87 are provided in parallel spaced relation at the inner circumference of the gasket flange 84. Thereby any product medium that may be penetrating is scraped off at the sealing points and an increased seal is obtained.

The flushing ring 49 shown in FIG. 1 and 3 permits cleaning the sealing bell 4 or the gasket flange 14 without disassembly of the suspension. In addition, this flushing ring 49 may be used as cooling system for the sealing bell 4.

According to FIG. 3, the air space 74 between the gasket flange 14 and the sealing bell 4 and the bearing box 18, 52, 32 may be regarded as an insulating layer. Besides, the universal joint 27 and the sealing ball parts may be flushed with sealing fluid or cooling fluid or with a gas from the inside. In this case connections for inflow and outflow 75, 76 of the cooling fluid are made in the cover 21.

Figure 4:
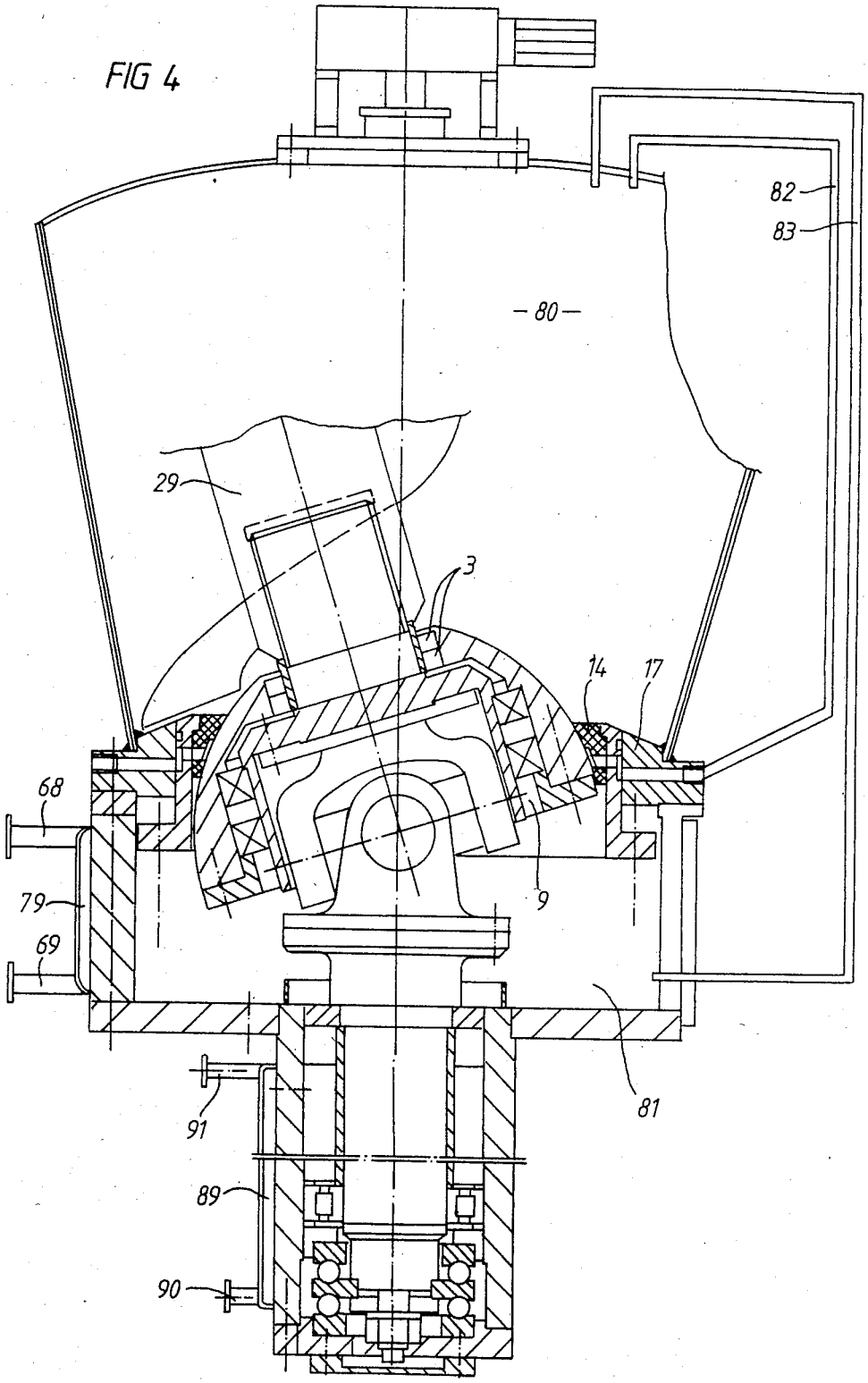
FIG. 4 is a vertical section, modified relative to FIG. 1, of the bottomside suspension with pressure equalization and cooling jacket.

According to FIG. 4, special pressure relief means are provided. In the product chamber 80 and in the bearing space 81 different pressures may occur. To relieve the seals 3, 9 and the gasket flange 14 of these additional pressure loads, a pressure equalization may be effected between product chamber 80 and bearing space 81. For this there are various possibilities. First a pressure relief of the gasket flange 14 can be achieved in that the product chamber 80 is connected with the flushing ring 49 by the pressure relief line 82. If only the bearing space 81 is to be pressure-relieved, and hence also the seals 3, then according to FIG. 4 a pressure relief must be effected with the second pressure relief line 83. Optimum pressure relief is obtained by a combination of these two pressure relief lines 82, 83 according to FIG. 4. The result is that the seals 3, 14 in contact with product have much longer useful lives. If such a pressure relief is to be effected at higher operating temperatures, the lower bearing block (bearing box) may be provided additionally with a cooling jacket. In this case according to FIG. 4, a lower cooling jacket 89 with the inlet 90 and the outlet 91 is provided, while the bearing box itself is cooled by a second cooling jacket 79 with the inlet 68 and the outlet 69.

Into the bearing space 74 air or sealing or cooling fluid is fed via inlet 77 and outlet 78, these said lines being possibly arranged in the cover 21.

I claim:

1. A conical screw mixer, comprising:

a conical mixing vessel which has a vertical axis and tapers inwardly toward the direction of a bottom region, said mixing vessel defining a product chamber and having a cover portion at the upper end thereof;

a rotationally driven mixing screw which runs generally parallel to and along an inner wall of the mixing vessel and has a lower end which is pivotably and rotatably mounted outside of said product chamber and below said bottom region of the mixing vessel;

a first drive secured on said cover portion and coupled to an upper end of said mixing screw for pivoting said mixing screw about the axis of said mixing vessel;

a pivotably mounted sealing bell with a central opening which spans said lower end of said screw mixer and defines an open space with said bottom region of said mixing vessel;

an angularly movable coupling housed within said pivotably mounted sealing bell;

a screw-in-bolt having an upper end inserted through said central opening of the sealing bell into said product chamber and attached to the lower end of the mixing screw, and a lower end attached to said angularly movable coupling by means of a screwable internal thread;

a second drive disposed below said mixing vessel and coupled and rotationally driving said screw-in-bolt for rotation of said mixing screw about its own axis;

an automatic readjustment sealing means adjacent to an outer surface of said sealing bell and separating the contents of said product chamber from said bottom region of said mixing vessel; and shim ring means axially and radially securing said screw-in-bolt and said screw-in-bolt being rotatably supported relative to said sealing bell, whereby said sealing bell follows the motion of said mixing screw as it pivots about the axis of said mixing bell, and said sealing bell does not follow the motion of said mixing screw as said mixing screw rotates about its own axis.

2. A conical screw mixer according to claim 1, wherein said angularly movable coupling is formed as a universal joint comprising said rotatable and pivotable screw-in bolt which extends into said product chamber and, is sealingly spanned by said sealing bell on an outer circumference of which a fixed gasket flange sealingly applies.

3. A conical screw mixer according to claim 2, wherein said bottom region of said mixing vessel is formed by a vessel flange welded to the side walls of said mixing vessel, on the inner side of which said fixed gasket flange is guided with a collar, said fixed gasket flange having a central cutout in which said sealing bell is rotatably and pivotally mounted by means of said universal joint.

4. A conical screw mixer according to claim 2 or 3, wherein said means for providing an automatic readjustment of a seal is disposed on said outer circumference of said fixed gasket flange on an inner circumference of a setting flange, and said setting flange presses said gasket flange against sealing surfaces of the sealing bell by means of spring-loaded set screws.

5. A conical screw mixer according to claim 2, wherein said fixed gasket flange applies by one or more circular grooves against the outer circumference of said sealing bell.

6. A conical screw mixer according to claim 2, wherein a flushing ring which is fluid conducting is disposed in a region of the sealing surface between said gasket flange and said sealing bell to receive a cooling or sealing fluid.

7. A conical screw mixer according to claim 2, wherein the movable part of the universal joint receives on the side of said sealing bell away from said product chamber a sealing fluid, a cooling fluid, or a gas.

8. A conical screw mixer according to claim 7, wherein said mixing screw is removable downwardly from said vessel flange after removal of said gasket and setting flange to facilitate the maintenance of the mixer.

9. A conical screw mixer according to claim 1, wherein said product chamber is connected with a flushing ring by a pressure relief line to form a pressure equalization region.

10. A conical screw mixer according to claim 1, wherein said product chamber is connected with a bearing space by a second pressure relief line to form a second equalization region.

11. A conical screw mixer according to claim 1, wherein said second drive further comprises a motor with a transmission flange connected to it.

12. A conical screw mixer according to claim 11, wherein said bottom region of said mixing vessel further comprises a second cover which is removable.

* * * * *